US005125391A

United States Patent [19]

Srivastava et al.

[11] Patent Number: 5,125,391

[45] Date of Patent: Jun. 30, 1992

[54] HEAT-RETAINING FOOD SERVICE CONTAINER

[75] Inventors: Ayodhya N. Srivastava, East Providence, R.I.; George Freedman, Wayland; Joseph Baer, Holliston, both of Mass.

[73] Assignee: Servolift Eastern Corporation, Dorchester, Mass.

[21] Appl. No.: 774,594

[22] Filed: Oct. 10, 1991

[51] Int. Cl.[5] ..... A47G 23/04

[52] U.S. Cl. ..... 126/246; 126/261; 126/400; 220/426; 220/429

[58] Field of Search ..... 126/246, 400, 263, 261; 220/429, 427, 426, DIG. 10, 556, 427, 426, 429; 206/557, 515; 165/918

[56] References Cited

U.S. PATENT DOCUMENTS

| | | | |
|---|---|---|---|
| 2,582,735 | 3/1949 | Alaj . | |
| 2,876,634 | 3/1959 | Zimmerman et al. | 126/400 X |
| 3,065,744 | 8/1961 | Scavullo . | |
| 3,148,676 | 9/1964 | Truog . | |
| 3,470,944 | 10/1969 | Segal . | |
| 3,557,774 | 1/1971 | Kreis . | |
| 3,603,106 | 9/1971 | Ryan . | |
| 3,734,077 | 5/1973 | Murdough . | |
| 3,837,330 | 9/1974 | Lanigan . | |
| 3,916,872 | 11/1975 | Kreis . | |
| 4,086,907 | 5/1978 | Rothschild . | |
| 4,184,601 | 1/1980 | Stewart . | |
| 4,246,884 | 1/1981 | Vandas . | |
| 4,258,695 | 3/1981 | McCarton . | |
| 4,505,252 | 3/1985 | Wada . | |
| 4,530,344 | 7/1985 | Iyengar . | |
| 4,559,921 | 12/1985 | Benmussa . | |
| 4,567,877 | 2/1986 | Sepahpur . | |

*Primary Examiner*—Larry Jones

*Attorney, Agent, or Firm*—Dressler, Goldsmith, Shore, Sutker & Milnamow, Ltd.

[57] ABSTRACT

A heat-retaining food service container includes an outer shell assembly, and an expandable inner container arrangement within which is disposed a mass of heat-fusible material. Attendant to heating of the heat-fusible material to an elevated temperature, the material undergoes a phase change and expansion. The expandable inner container arrangement accommodates such expansion of the fusible material, while avoiding any appreciable deformation of the outer shell assembly. The construction promotes efficient heat-transfer to food within the container.

13 Claims, 2 Drawing Sheets

HEAT-RETAINING FOOD SERVICE CONTAINER

TECHNICAL FIELD

The present invention relates generally to a heat-retaining food service container for keeping food warm for extended periods, and more particularly to a container construction including an outer shell assembly, and an expandable inner container arrangement which holds a mass of heat-fusible material. The construction is configured to avoid any substantial deformation of the outer shell assembly attendant to heating and expansion of the fusible material.

BACKGROUND OF THE INVENTION

There are many types of food service operations which require use of arrangements to keep food warm after its preparation, and prior to service. For example, hospitals, nursing homes, banquet halls, hotels, and some types of restaurant establishments, typically have a central kitchen in which food preparation is effected, with the food then transported and delivered to other areas. Depending upon the nature of the operation, it can be as long as one-half hour or more, between the time at which preparation of the food is complete, and when it is eventually served.

Of course, the sensory appeal of the food is diminished if it is not kept warm after preparation and prior to service. Accordingly, a variety of different types of devices have been used in the past in order to promote the service of food while still warm. For example, relatively large, insulated cabinets may be employed for transporting a number of individual meals until they are ready for service. However, cabinets of this nature are of limited effectiveness, and do not always maintain the food as warm as desired for sufficient periods of time. Additionally, such cabinets are typically bulky, and can be unwieldy when used in certain types of environments.

Devices are also known for keeping individual plates of food warm after preparation and prior to service. For example, insulated containers can be effective for keeping food warm for relatively short periods of time, but such containers are not typically sufficiently effective for keeping food warm for relatively long periods.

Other individual containers are configured to permit heating of the container to an elevated temperature so that food is kept warm for a relatively greater period. However, previous devices of this nature have suffered from distinct drawbacks. Some previous container devices have not leant themselves to efficient and rapid heating, which thus detracts from the convenient and efficient use of the devices. Further, some previous arrangements have not promoted efficient heat transfer to the food, thus failing to maintain the food at the desired temperature. Other arrangements have not exhibited sufficient heat-storage capacity in order to provide desired heat-retaining characteristics for sufficient time periods.

The present invention contemplates a heat-retaining food service container configured for holding and containing individual plates of food, with the container particularly configured for economical manufacture and use, efficient heating and handling, and improved heat-retaining characteristics.

SUMMARY OF THE INVENTION

The heat-retaining food service container embodying the principles of the present invention is configured in the form of an outer shell assembly, and an inner container arrangement, which together cooperate for convenient and efficient use, as well as enhanced heat-retaining characteristics. Heat-storing, fusible material is disposed within the inner container arrangement, with the inner container configured for expansion relative to the outer shell assembly attendant to heating and expansion of the fusible material. The construction is configured such that this expansion of the fusible material is accommodated without any substantial deformation of the outer shell assembly. Heat-transfer to an associated plate having food is facilitated, while avoiding heat loss through other portions of the shell assembly by the provision of an insulating internal cavity.

In accordance with the illustrated embodiment, the outer shell assembly of the present food service container includes an upper shell member, and a lower shell member, which are permanently joined to each other at peripheral portions thereof. The construction further includes an expandable, inner container arrangement positioned within the outer shell assembly. The expandable inner container includes at least a portion which is movable relative to the outer shell assembly so that an initial interior volume defined by the inner container is expandable. In a preferred form, the inner container arrangement includes an upper container element positioned adjacent the upper shell member, and a lower container element positioned generally adjacent the lower shell member, with the lower container element including an upwardly domed central portion which is resiliently movable downwardly toward the lower shell member for expansion.

A heat-storage medium is disposed within the expandable inner container arrangement, and comprises a mass of fusible material which can be heated to a relatively elevated temperature. In a presently preferred embodiment, the fusible material comprises wax-like crystalline aliphatic hydrocarbon material.

In the preferred embodiment, the inner container arrangement of the present construction comprises metallic material (preferably aluminum) with this arrangement promoting efficient heat transfer. Attendant to heating, the fusible material undergoes a phase change from solid to liquid, and is thus subject to expansion. The expandable inner container arrangement accommodates such expansion of the fusible material without subjecting the outer shell assembly to any appreciable deformation.

In accordance with the illustrated embodiment, the upper container element of the expandable inner container is generally disk-shaped, and is fixedly mounted on the upper shell member in heat-transferring relationship therewith. In order to further promote heat-transfer from the fusible material to the upper shell member (and thus to food within the container construction) the upper container element preferably includes a plurality of elongated heat-transferring fins depending therefrom. The fins are in heat-transferring contact with the fusible material, and promote both efficient heating of the fusible material, as well as efficient heat-transfer to food disposed in the container for service.

In the preferred form, the expandable inner container is sealed by virtue of a rim portion of the lower container element being disposed in sealing engagement with the upper shell member of the outer shell assembly. The components are configured such that an internal cavity is thus defined between the lower container member and the outer shell assembly. This internal cavity desirably acts to insulate the expandable inner container from the lower shell member, thereby minimizing heat loss through this portion of the outer shell assembly.

Other features and advantages of the present invention will become readily apparent from the following detailed description, the accompanying drawings, and the appended claims.

DETAILED DESCRIPTION

Figure 1:
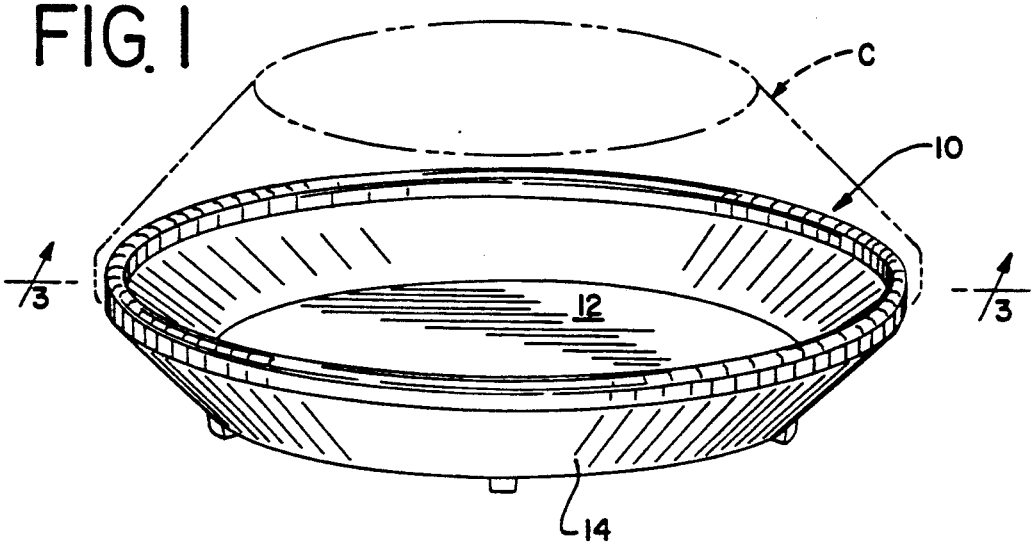
FIG. 1 is a perspective view of a heat-retaining food service container embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference now to the drawings, therein is illustrated a heat-retaining food service container 10 embodying the principles of the present invention. In accordance with the present invention, the food service container 10 includes an outer shell assembly, and an expandable inner container arrangement, with a heat-storing fusible material disposed within the inner container arrangement. As will be further described, the inner container arrangement is expandable attendant to heating of the fusible material, with such expansion accommodated without any appreciable deformation of the outer shell assembly.

The drawings illustrate the presently preferred configuration of the present food service container, wherein the container is generally dish-shaped, thus facilitating holding and containing of an associated plate (not shown) having food. If desired, an associated cover C can be employed in conjunction with the container 10 thus further promoting the heat-retention characteristics of the container.

As shown, the outer shell assembly of the construction includes a generally dish-shaped upper shell member 12, and a generally complementary dish-shaped lower shell member 14. The upper and lower shell members 12 and 14 preferably comprise suitable polymeric, plastic material, with Amoco Mindel S-1010 having been found to be suitable. The upper and lower shell members are fixedly and sealingly joined to each other about peripheral portions thereof, preferably by ultrasonic welding.

The expandable inner container arrangement of the present container 10 includes a generally disk-shaped, generally planar upper container element 16 positioned adjacent to upper shell member 12 in heat-transferring relationship therewith, and a dish-shaped lower container element 18 positioned generally adjacent lower shell member 14.

The upper and lower container elements 16 and 18 are preferably formed from metallic material, with 0.016 inch thick type 3003 aluminum for the upper element 16, and 0.015 inch thick type 1100 aluminum for the lower element 18, having proven suitable in a current embodiment. As will be further described, at least a portion of the inner container arrangement is movable relative to the outer shell assembly so that an initial interior volume defined by the container is expandable.

The storage of thermal energy in the present container construction is principally effected through the provision of a mass of fusible material 20 positioned within the expandable inner container arrangement. While the fusible material may be provided in any of a variety of forms, the use of wax-like crystalline aliphatic hydrocarbon material is presently preferred. One specific material which has proven suitable is marketed as Polywax 655 Polyethylene, by Petrolite Specialty Polymers Group, Tulsa, Okla.

As will be appreciated, fusible material 20 of the above-described nature typically undergoes a phase change from substantially solid to liquid form, attendant to heating of the material to an elevated temperature for use of the present food service container. Attendant to this phase change, the material undergoes significant expansion, which expansion is specifically accommodated by the configuration of the expandable inner container, and in particular, the configuration of the lower container element 18.

Figure 4:
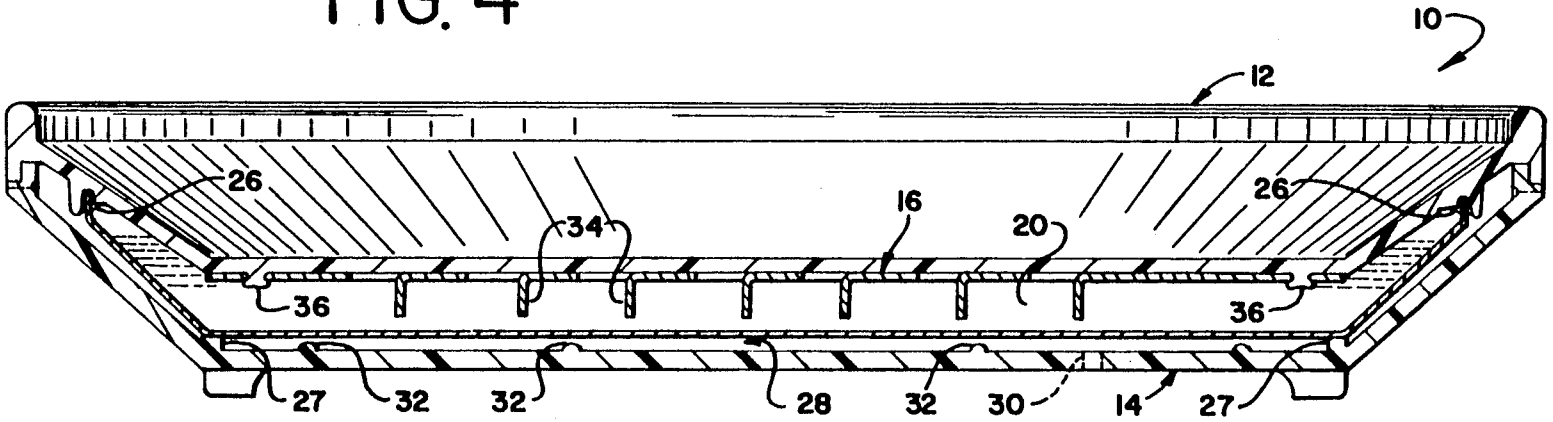
FIG. 4 is a cross-sectional view similar to FIG. 3 illustrating the present food service container subsequent to heating.

To this end, the lower container element 18 includes an upwardly domed central portion 22 which, as illustrated in FIG. 4, is resiliently movable downwardly toward the lower shell member 16 attendant to expansion of fusible material 20. In a current embodiment, the central portion 22 of the lower container element 18 has a diameter on the order of 6.95 inches, and a vertical dimension on the order of 0.15 inches.

In order to contain the fusible material 20 within the inner container arrangement, an upwardly extending rim portion 24 of the lower container element is received in sealing engagement within a downwardly open groove defined by upper shell member 12. Suitable sealant, which in a current embodiment comprises silicone adhesive sealant 26, is preferably provided. General Electric silicone adhesive sealant RTV162 has proven suitable in a current embodiment.

In order to maintain the rim portion 24 of the lower container element 18 in desired engagement with the upper shell member 12, lower shell member 14 preferably defines an annular support 27 which engages and presses against the lower container element, generally at the juncture of domed central portion 22 and rim portion 24. This arrangement acts to upwardly urge and maintain the lower container element 18 in position within the outer shell assembly as the domed central portion 22 of the lower container element flexes downwardly and upwardly attendant to heating an cooling, and expansion and contractions of fusible material 20.

As Will be appreciated, the illustrated arrangement provides an internal cavity 28 between the lower container element 18 and the outer shell assembly. In particular, this internal cavity 28 extends between the domed central portion 22 and the lower shell member 14, and about the rim portion 24 of the container element 18. This internal cavity desirably acts to insulate the lower shell member 14 from the fusible material 20, thus minimizing heat loss through the lower portion of the outer shell assembly, and extending the time during which food is kept at serving temperature.

In the preferred form, the internal cavity is preferably under partial vacuum prior to expansion of the internal container arrangement. This is achieved by venting the internal cavity, such as through vent hole 30 (FIG. 4) after initial assembly of the container construction, and after subjecting the fusible mass 20 to expansion. Such expansion results in the domed central portion 22 moving downwardly, thereby expelling air from the external cavity through the vent hole. The vent hole 30 is then plugged, or the internal cavity otherwise sealed, with subsequent cooling of the fusible mass 20, and resultant contraction and upward movement of the upwardly resilient domed central portion 22, acting to subject the internal cavity 28 to partial vacuum.

As noted, the lower container element 18 is sealingly mated with the upper shell member 12 to thereby seal fusible material 20 within the container arrangement. It is also preferred that the upper and lower shell member 12 and 14 be sealed to each other to maintain the partial vacuum created in internal cavity 28.

To maintain the desired insulating space between the lower container element 18 and the lower shell member, expansion-limiting means are preferably provided in the form of annular spacer elements 32 which extend integrally upwardly from the interior lower surface of the lower shell member 14.

Figure 2:
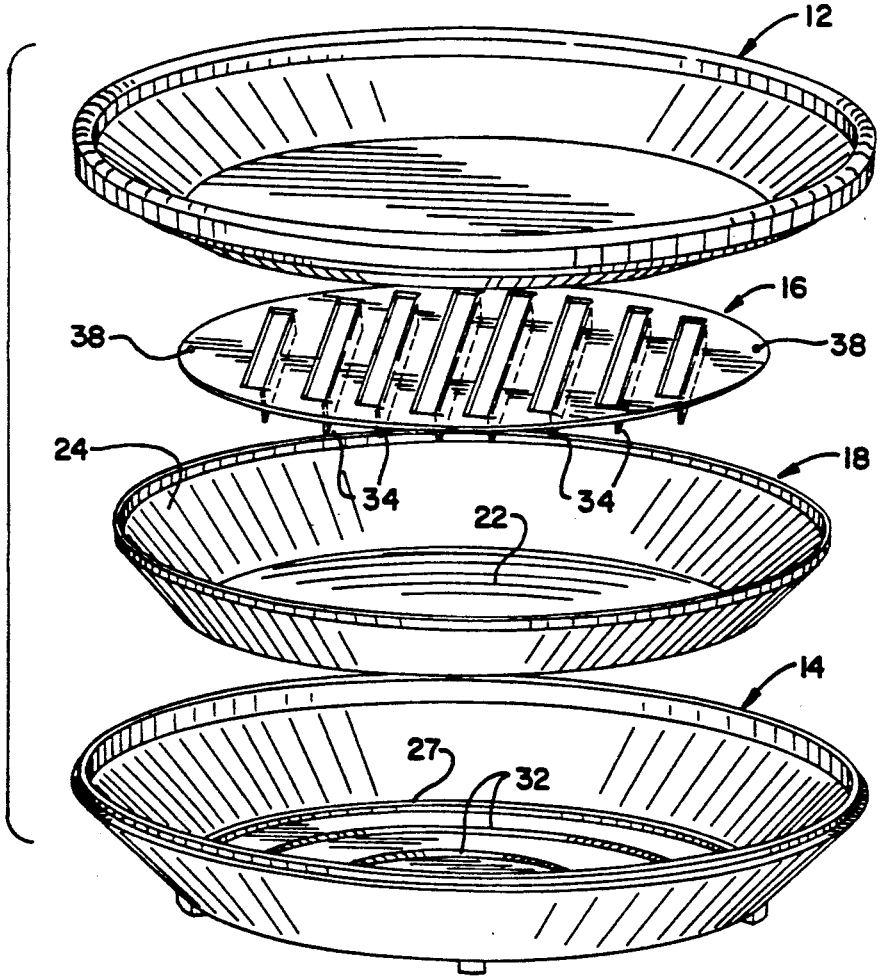
FIG. 2 is an exploded perspective view of the food service container illustrated in FIG. 1.
Figure 3:
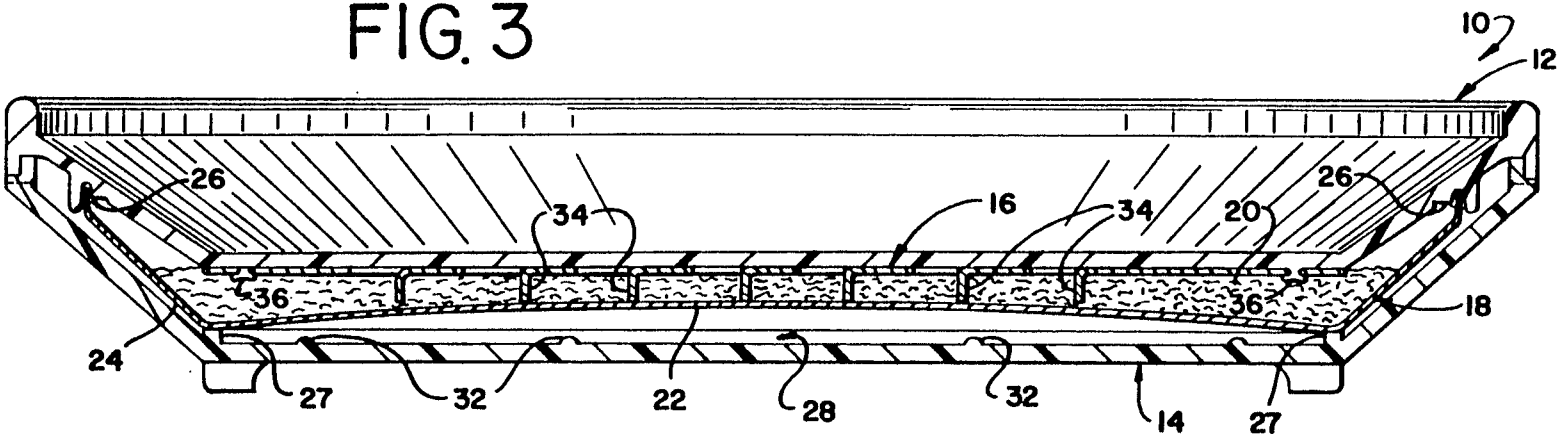
FIG. 3 is a cross-sectional view taken along lines 3—3 of FIG. 1 illustrating the present food-service container prior to heating thereof.

As noted above, food positioned within the container 10 is kept warm by the transfer of heat from the heat fusible material 20 through the upper shell member 12. In order to promote efficient heat transfer, the upper container element 16 includes an internal fin arrangement in the form of a plurality of integrally depending elongated fins 34. Fins 34 are positioned in heat-transferring contact with the fusible mass 20, thus promoting heat transfer between the fusible mass, the upper container element 16, and the upper shell member 12. In the preferred form, the upper container element 16 is fixedly mounted on the lower inside surface of the upper shell member 12 by suitable staking projections 36 extending through openings 38 (see FIG. 2) in the upper container element.

From the foregoing, it will be observed that numerous modifications and variations can be effected without departing from the true spirit and scope of the novel concept of the present invention. It is to be understood that no limitation with respect to the specific embodiment illustrated her-in is intended or should be inferred. The disclosure is intended to cover by the appended claims all such modifications as fall within the scope of the claims.

What is claimed is:

1. A heat-retaining food service container comprising:

an outer shell assembly including an upper shell member, and a lower shell member, joined to each other at peripheral portions thereof;

expandable container means positioned within said outer shell assembly, said container means including at least a portion movable relative to said outer shell assembly so that an initial interior volume defined by said container means is expandable; and heat-storage means disposed within said expandable container means, said heat-storage means comprising a mass of fusible material which can be heated to a relatively elevated temperature, said fusible material being subject to expansion attendant to heating, said expandable container means accommodating expansion of said fusible material without subjecting said outer shell assembly to any appreciable deformation, said expandable container means comprising an upper container element positioned adjacent said upper shell member, and a lower container element positioned generally adjacent said lower shell member, one of said upper and lower container elements being movable relative to said outer shell assembly for accommodating expansion of said fusible material, said expandable container means including internal fin means in heat transferring contact with said fusible material, said internal fin means comprising a plurality of elongated fins depending from said upper container element.

2. The food service container in accordance with claim 1, wherein said expandable container means includes an upwardly domed central portion which is movable downwardly, from a position in engagement with said internal fin means, toward said lower shell member for accommodating expansion of said fusible material.

3. The food service container in accordance with claim 1, wherein said outer shell assembly and said expandable container means define an internal cavity therebetween, said internal cavity being under partial vacuum prior to expansion of said container means.

4. A heat-retaining food service container, comprising:

an outer shell assembly including a generally dish shaped upper shell member, and a generally complementary dish-shaped lower shell member, joined to each other at peripheral portions thereof;

expandable container means positioned within said outer shell assembly, said container means including a generally planar upper container element positioned generally adjacent said upper shell member, and a generally dish-shaped lower container element positioned generally adjacent said lower shell member, said lower container element including an upwardly domed central portion which is movable downwardly so that an initial interior volume defined by said container means is expandable; and heat-storage means disposed within said expandable container means, said heat-storage means comprising a mass of fusible material which can be heated to a relatively elevated temperature, said fusible material being subject to expansion attendant to heating and a phase change thereof, said central portion of said lower container element being movable downwardly under the influence of expansion of the fusible material to accommodate the expansion without subjecting the outer shell assembly to any appreciable deformation, said upper shell member defining a downwardly opening annular groove, said lower container element including an upwardly extending rim portion surrounding said domed central portion, said rim portion being disposed in sealing engagement with said upper shell member by disposition of said rim portion in said downwardly opening annular groove so that an internal cavity is defined between said lower container element and said outer shell assembly, said lower shell member including support means in engagement with said lower container element at a juncture of said rim portion and said domed central portion for maintaining said rim portion in engagement with said upper shell member.

5. The food service container in accordance with claim 4, wherein said outer shell assembly and said expandable container means define an internal cavity therebetween, said internal cavity being under partial vacuum prior to expansion of said container means.

6. The food service container in accordance with claim 4, wherein said internal cavity extends between the upwardly domed central portion of said lower container element and said lower shell member, and about the rim portion of said lower container element to thereby insulate said lower shell member from said heat fusible material.

7. The food service container in accordance with claim 6, wherein said lower shell member includes means for limiting downward movement of said central portion of said lower container element to substantially maintain said central portion in spaced relationship from said lower shell member.

8. The food service container in accordance with claim 6, wherein said outer shell assembly comprises plastic material, and said expandable container means comprises metallic material.

9. The food service container in accordance with claim 8, wherein said heat-fusible material comprises crystalline aliphatic hydrocarbon material.

10. The food service container in accordance with claim 4, wherein said upper container element is fixedly mounted on said upper shell member.

11. The food service container in accordance with claim 10, wherein said upper container element includes a plurality of depending heat-transferring fins in heat-transferring contact with said fusible material.

12. The food service container in accordance with claim 10, including means staking said generally planar upper container element to a lower inside surface of said upper shell member for fixedly mounting said upper container element thereon.

13. A heat-retaining food service container, comprising:

an outer shell assembly including a generally dish shaped upper shell member, and a generally complementary dish-shaped lower shell member, joined to each other at peripheral portions thereof;

expandable container means positioned within said outer shell assembly, said container means including a generally planar upper container element positioned generally adjacent said upper shell member, and a generally dish-shaped lower container element positioned generally adjacent said lower shell member, said lower container element including an upwardly domed central portion which is movable downwardly so that an initial interior volume defined by said container means is expandable; and heat-storage means disposed within said expandable container means, said heat-storage means comprising a mass of fusible material which can be heated to a relatively elevated temperature, said fusible material being subject to expansion attendant to heating and a phase change thereof, said central portion of said lower container element being movable downwardly under the influence of expansion of the fusible material to accommodate the expansion without subjecting the outer shell assembly to any appreciable deformation, said lower container element including an upwardly extending rim portion surrounding said domed central portion, said rim portion being disposed in sealing engagement with said upper shell member so that an internal cavity is defined between said lower container element and said outer shell assembly, said internal cavity extending between the upwardly domed central portion of said lower container element and said lower shell member, and about the rim portion of said lower container element to thereby insulate said lower shell member from said heat fusible material, said internal cavity being under partial vacuum prior to expansion of said container means.

* * * * *